United States Patent [19]

Abel

[11] Patent Number: 4,617,992

[45] Date of Patent: Oct. 21, 1986

[54] SYSTEM AND CHOKE VALVE ACTUATOR MECHANISM FOR OPERATING A PLUNGER LIFT WELL

[76] Inventor: Thomas E. Abel, 1183 MacIntosh Dr., Dellroy, Ohio 44620

[21] Appl. No.: 730,049

[22] Filed: May 3, 1985

[51] Int. Cl.[4] ..... E21B 34/02; F16K 31/122

[52] U.S. Cl. ..... 166/95; 166/91; 251/14

[58] Field of Search ..... 166/95, 91, 97, 72, 166/53, 54; 251/14

[56] References Cited

U.S. PATENT DOCUMENTS

| | | | |
|---|---|---|---|
| 2,132,199 | 10/1938 | Yancey | 166/91 |
| 2,644,485 | 7/1953 | Schwendner | 251/14 |
| 2,733,041 | 1/1956 | Crookston | 251/14 |
| 2,905,429 | 9/1959 | Gibson | 251/14 |
| 2,991,042 | 7/1961 | Natho | 251/14 |
| 3,029,060 | 4/1962 | Anderson | 251/14 |
| 3,253,610 | 5/1966 | Pahl et al. | 251/14 X |
| 3,378,224 | 4/1968 | Boyle | 251/14 |
| 3,402,912 | 9/1968 | Watkins | 251/14 |
| 3,417,960 | 12/1968 | Stehlin | 251/14 |
| 3,889,922 | 6/1975 | Peters | 251/14 |
| 4,194,718 | 3/1980 | Baker et al. | 251/14 |
| 4,211,279 | 7/1980 | Isaacks | 166/53 X |
| 4,215,746 | 8/1980 | Hallden et al. | 166/53 |
| 4,337,788 | 7/1982 | Seger | 166/91 X |
| 4,436,148 | 3/1984 | Maxwell | 166/91 X |
| 4,493,336 | 1/1985 | Renfro | 251/14 X |

*Primary Examiner*—Stephen J. Novosad
*Assistant Examiner*—Thuy M. Bui
*Attorney, Agent, or Firm*—Mack D. Cook, II

[57] ABSTRACT

An operating system and choke valve actuator mechanism for a plunger lift gas and oil well having a casing and a tubing string. The actuator mechanism has a manual "low stage" setting for the choke valve so that low velocity gas will flow from the tubing string. The system has a control unit responsive to a pressure differential between casing gas (high) and tubing string gas (low) to move the actuator mechanism to a "high stage" setting for the choke valve so that high velocity gas and oil will flow for the tubing string.

4 Claims, 4 Drawing Figures

20
46
120
61
41
40
131
124
39
54
55
37
129
35
132
23
128
134
25
22
127
133
27
125
122
29
G
121
130
SEPERATOR
STORAGE
TRANSMISSION
W
121
122
123

SYSTEM AND CHOKE VALVE ACTUATOR MECHANISM FOR OPERATING A PLUNGER LIFT WELL

BACKGROUND OF THE INVENTION

The present invention relates to an improved system for the operation of a plunger lift or "rabbit" oil and gas well. The invention also relates to an actuator mechanism for selectively positioning a choke valve element relative to a valve seat within a piping flow tee for regulating the flow of gas and oil from the tubing string of a plunger lift well.

A plunger lift well has an outer casing and an inner tubing string. The casing is a barrier between the strata through which the well was drilled and the annular area of the drilled hole. The casing is perforated at locations within the source rock for passage of gas and oil into the annular area of the casing. The tubing string extends coaxially down the casing and terminates generally at the source rock. The lower end of the tubing string is formed to provide a stop or seat for a lift plunger. Delivery of gas and oil from the tubing string is selectively controlled by the system and actuator mechanism of the invention.

A lift plunger is a solid bar, 12" to 18" in length, having an outer diameter less than the inner diameter of the tubing string and free to move up and down the tubing string in response to pressure differentials between the casing and the tubing string. Well gas entering the annular area of the casing through the perforations causes a buildup of gas pressure within the casing. The increase in casing gas pressure causes gas and oil within the casing to enter the annular area of the tubing string through the open lower end. The rise of an oil column within the tubing string and above the plunger, toward the wellhead, is selectively controlled, at the option of the well operator, by a "low stage" setting of the actuator mechanism of the invention. The "low stage" setting vents gas in the tubing string through the wellhead piping flow tee. The plunger will remain at the bottom of the tubing string.

When the pressure differential between the casing (high) and the tubing string (low) has reached a value, as established by the well operator, a "high stage" setting of the actuator mechanism of the invention will reduce the pressure above the oil column in the tubing string and the plunger will rise forcing the oil above the plunger through the wellhead piping flow tee.

SUMMARY OF THE INVENTION

The object of the invention is to provide an improved system for the operation of a plunger lift well. The system incorporates an improved actuator mechanism for selectively positioning a choke valve element relative to a valve seat within a piping flow tee for regulating the flow of gas and oil from the tubing string of a plunger lift well.

A further object of the invention is to provide a plunger lift well operating system and choke valve operating mechanism which may be easily installed on new or existing wellheads, in combination with known and conventional components, which will operate with only occasional maintenance, and which will automatically control a well operation over long periods of time.

These and other objects of the invention, as well as the operating advantages thereof, will be apparent in view of the following drawings and specification.

In general, an actuator mechanism according to the invention positions a choke valve element relative to a valve seat within a piping flow tee for regulating the flow of gas and oil from a producing wellhead. The flow tee has an opening to receive and connect the actuator mechanism, an inlet opening for conducting gas and oil toward the choke valve seat and an outlet opening for conducting gas and oil beyond the choke valve seat.

The actuator mechanism comprises a closed body member with a base end adapted for connection with the flow tee opening, a control shaft positioning collar housed within the body member, a cylinder member connected to the upper end of the body member, a control piston housed within the cylinder member, a cap member connected to the upper end of the cylinder member, a control piston stop sleeve carried by the cap member and an elongated control shaft.

The control shaft extends coaxially through the body member, the control shaft positioning collar, the cylinder member, the control piston, the cylinder cap member and the stop sleeve.

The body member, the cylinder member and the stop sleeve each have a small diameter axial bore for rotatable and slidable mounting of the control shaft.

The control shaft has an upper end projecting above the stop sleeve and adapted for carrying a handwheel thereon. The control shaft has a lower end projecting below the body member and into the flow tee and adapted for carrying the choke valve element thereon.

The body member upper end has a large diamter chamber bore extending radially above the axial bore therein for nonrotatable mounting and seating of the control shaft positioning collar.

The cylinder member has a larger diameter piston bore extending radially above the axial bore therein for movable mounting of the control piston. The cylinder member also has a control fluid supply conduit extending from the external surface of the cylinder member and into the lower face of the piston bore.

The cylinder cap member has an axial bore therein adapted for rotatable and manually adjustable mounting of the stop sleeve coaxially around the section of the control shaft within the cylinder member.

The control shaft is connected to the control piston within the cylinder piston bore. The control shaft is raisable toward the cylinder cap member in response to the pressure of a control fluid introduced into the piston bore through the cylinder fluid supply conduit. The control shaft is raisable against a compression means seated around the stop sleeve between the cap member and the control piston.

The control shaft has a section within the body member adapted for rotatable engagement with the control shaft positioning collar.

In general, a system according to the invention to control the flow of gas from the tubing string of a plunger lift well having a casing, uses the choke valve actuator mechanism, a choke valve element and a piping flow tee as shown in FIGS. 1, 2 and 3. The system includes an electrically powered well gas actuated control unit having electronic components to actuate fluid pressure functions, at remote locations.

The control unit is supplied with gas from the casing through a conduit. The control unit will convert the casing gas pressure to a first analog value. The control unit is also supplied with gas from the tubing string through a conduit. The control unit will convert the tubing string gas pressure to a second analog value. The tubing string communicates with the piping flow tee through a transmission pipe. The transmission pipe has a control valve actuated by the control unit.

The system functions so that the flow of tubing string gas into the piping flow tee is controlled by manual setting of the choke valve element to the "low stage" condition as shown in FIG. 2 and the opening of the transmission pipe control valve by the control unit. The tubing string thereafter is being filled with oil above the plunger until the control unit senses a predetermined difference between the first analog value and the second analog value. Then, at that time, the control unit actuates the control piston of the actuator mechanism by the introduction of fluid pressure into the cylinder member piston bore through the control fluid supply conduit and the choke valve element is moved to the "high stage" condition as shown in FIG. 3. At which time, oil above the plunger in the tubing string will flow into the piping flow tee.

IN THE DRAWINGS

DETAILED DESCRIPTION OF THE INVENTION

Figure 1:
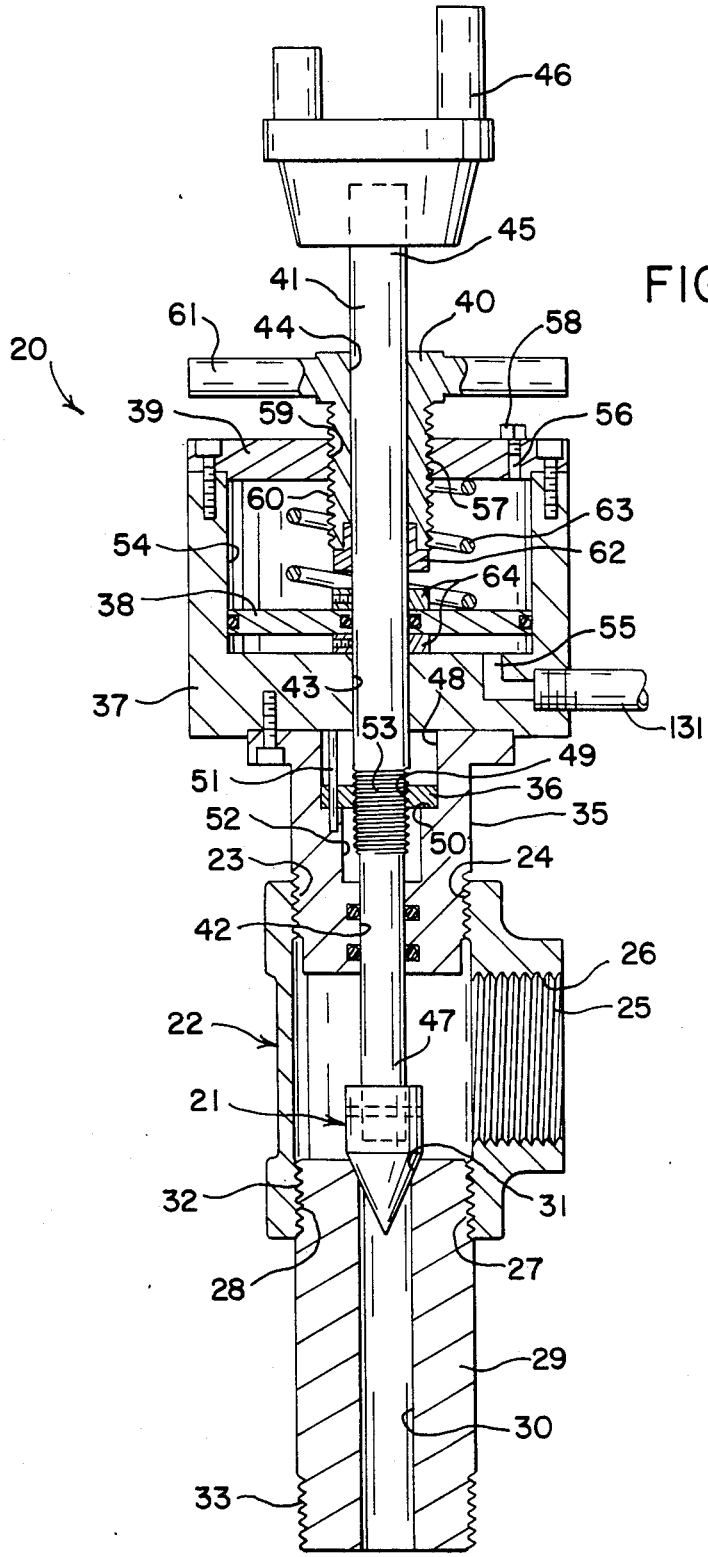
FIG. 1 is a sectional view of an actuator mechanism, a choke valve element and a piping flow tee according to the invention, the choke valve element being is a closed condition.

With specific reference to FIG. 1, an actuator mechanism according to the invention, for selective positioning of a choke valve element relative to a valve seat within a piping flow tee for regulating the flow of gas and oil from a producing wellhead, is referred to generally by the numeral 20. A choke valve element is indicated at 21. A piping flow tee is indicated at 22.

A flow tee 22 has an opening 23 to receive the actuator mechanism 20. As shown, the tee opening 23 is the upper one of three openings and has internal machine threads 24. A flow tee 22 also has an inlet opening 25 to receive piping for conducting gas and oil toward the choke valve element 21. As shown, the tee opening 25 is the side one of three openings and has internal machine threads 26 for mating engagement with external threads on suitable piping (not shown). A flow tee 22 further has an outlet opening 27 for conducting gas and oil beyond the choke valve element 21. As shown, the tee opening 27 is the lower one of three openings and has internal machine threads 28.

A flow tee 22 also has a gas and oil outlet passage opposed to the actuator mechanism tee opening 23. As shown, the outlet opening 27 carries a short downwardly directed union body 29 with an axial outlet bore 30 extending therethrough. The upper end of the union bore 30 has a suitable shaped machined valve seat 31 for closed and sealed engagement with the body of the choke valve element 21. The upper end of the union body 29 has external threads 32 for mating engagement with outlet opening threads 28. The lower end of the union body 29 may have external threads 33 for connection thereto of suitable piping (not shown), for transmission of gas and oil to conventional seperators, storage tanks and transmission piping (not shown).

The primary components of an actuator mechanism 20 include a closed body member 35 with a base end adapted for connection with the upper flow tee opening threads 24, a control shaft positioning collar 36 housed within the body member 35, a cylinder member 37 connected to the upper end of the body member 35, a control piston 38 housed within the cylinder member 37, a cap member 39 connected to the upper end of the cylinder member 37, a control piston stop sleeve 40 carried by the cap member 39 and an elongated control shaft 41. The control shaft 41 extends coaxially through the body member 35, the positioning collar 36, the cylinder member 37, the control piston 38, the cap member 39 and the stop sleeve 40, toward the choke valve seat 31.

The body member 35, the cylinder member 37 and the stop sleeve 40 each have a small diameter axial bore, 42, 43, and 44, respectively, for rotatable and slidable mounting of the control shaft 41. The control shaft 41 has an upper end 45 projecting above the stop sleeve 40 and adapted for carrying a handwheel 46 thereon. The control shaft 41 has a lower end 47 projecting below the body member 35 and into the flow tee 22 and adapted for carrying the choke valve element 21 thereon.

The upper end of the actuator body member 35 has a larger diameter chamber bore 48 extending radially above the axial bore 42 therein. The chamber bore 48 provides for nonrotatable mounting and seating of the control shaft positioning collar 36. As shown, the positioning collar 36 has an axial portion with internal machine threads 49 for rotatable engagement with the control shaft 41. The chamber bore 48 has a shoulder 50 for seating the positioning collar 36. The positioning collar 36 is nonrotatably secured by a slide pin 51 inserted into and projecting above the bore shoulder 50. Below the bore shoulder 50, the body member 35 has an intermediate diameter bore 52 for unrestricted movement of a section of the control shaft 41 having external threads 53 for mating engagement with the positioning collar internal threads 49.

The actuator cylinder member 37 has a larger diameter piston bore 54 extending radially above the axial bore 43 therein for movable mounting of the control piston 38. A control fluid supply conduit 55 extends from the external surface of the cylinder member 37 and into the lower face of the piston bore 54.

The actuator cylinder cap member 39 may have an exhaust port 56 therethrough. The cap member 39 has an axial bore 57 adapted for rotatable and manually adjustable mounting of the control piston stop sleeve 40 coaxially around the section of control shaft 41 within the cylinder member 37. As shown, the exhaust port 56 is protected by a suitable plug 58. The cap member axial bore 57 has internal machine threads 59 for mating engagement with external threads 60 on the stop sleeve 40. Above the cap member 39, the upper end of the stop sleeve 40 has handle elements 61 for manual rotation thereof. Within the cylinder member 37, the lower end of the stop sleeve 40 may carry a thrust plate 62.

The control shaft 41 is connected to the control piston 38 within the cylinder piston bore 54. The piston 38 and the control shaft 41 are raisable toward the actuator cylinder cap member 39 in response to the pressure of a control fluid introduced into the piston bore 54 through the cylinder fluid supply conduit 55. A raising movement of the piston 38 and the control shaft 41 is against a compression means 63 seated around the control piston stop sleeve 40. As shown, the piston 38 is connected to the control shaft 41 by two, upper and lower, lock collars 64. Upward movement of the piston 38 and the actuator shaft 41 will be limited by contact of the upper lock collar 64 with the thrust plate 62. The compression means 63 is a coiled spring seated between the upper face of the piston 38 and the under side of the cylinder cap member 39.

Figure 2:
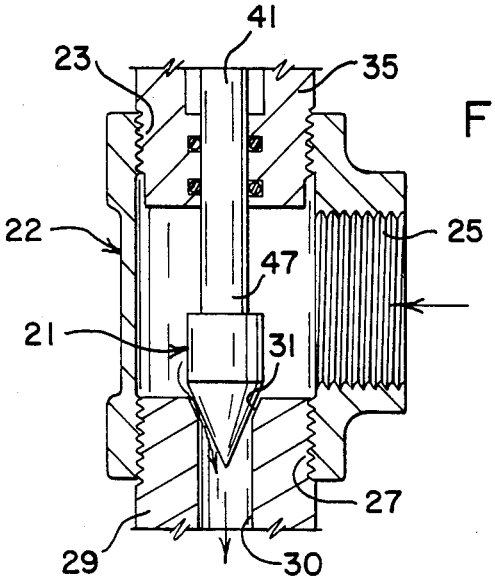
FIG. 2 is a fragmentary sectional view showing the choke valve element in a "low stage" condition so that only gas from the well tubing string will flow into the piping flow tee.

The well operator may move the choke valve element 21 from the closed condition shown in FIG. 1 to the "low stage" condition shown in FIG. 2 by rotation of the handwheel 46. The control shaft threads 53 will move relative to the threads 49 of the fixed positioning collar 36.

Figure 3:
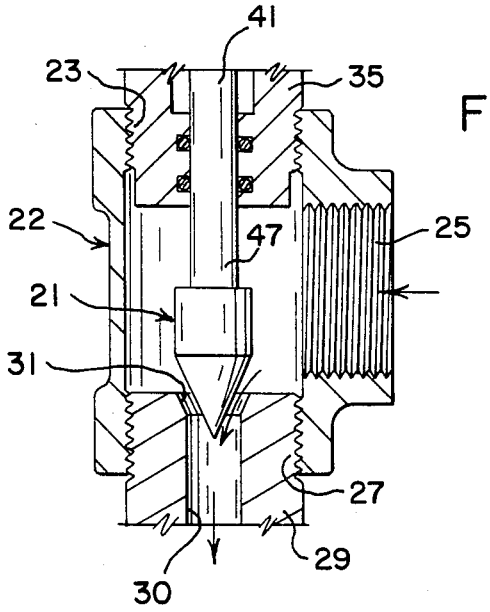
FIG. 3 is a fragmentary sectional view showing the choke valve element in a "high stage" condition so that oil from the tubing string will flow into the piping flow tee.

The choke valve element 21 is further moved to the "high stage" condition shown in FIG. 3 in response to the pressure of a control fluid introduced into the piston bore 54 through the cylinder fluid supply conduit 55.

A plunger lift well control system according to the invention, using the apparatus of FIG. 1, is referred to generally by the numeral 120. A control system 120 will function when the actuator mechanism 20, choke valve element 21 and piping flow tee 22 are used in the environment of FIG. 4.

Figure 4:
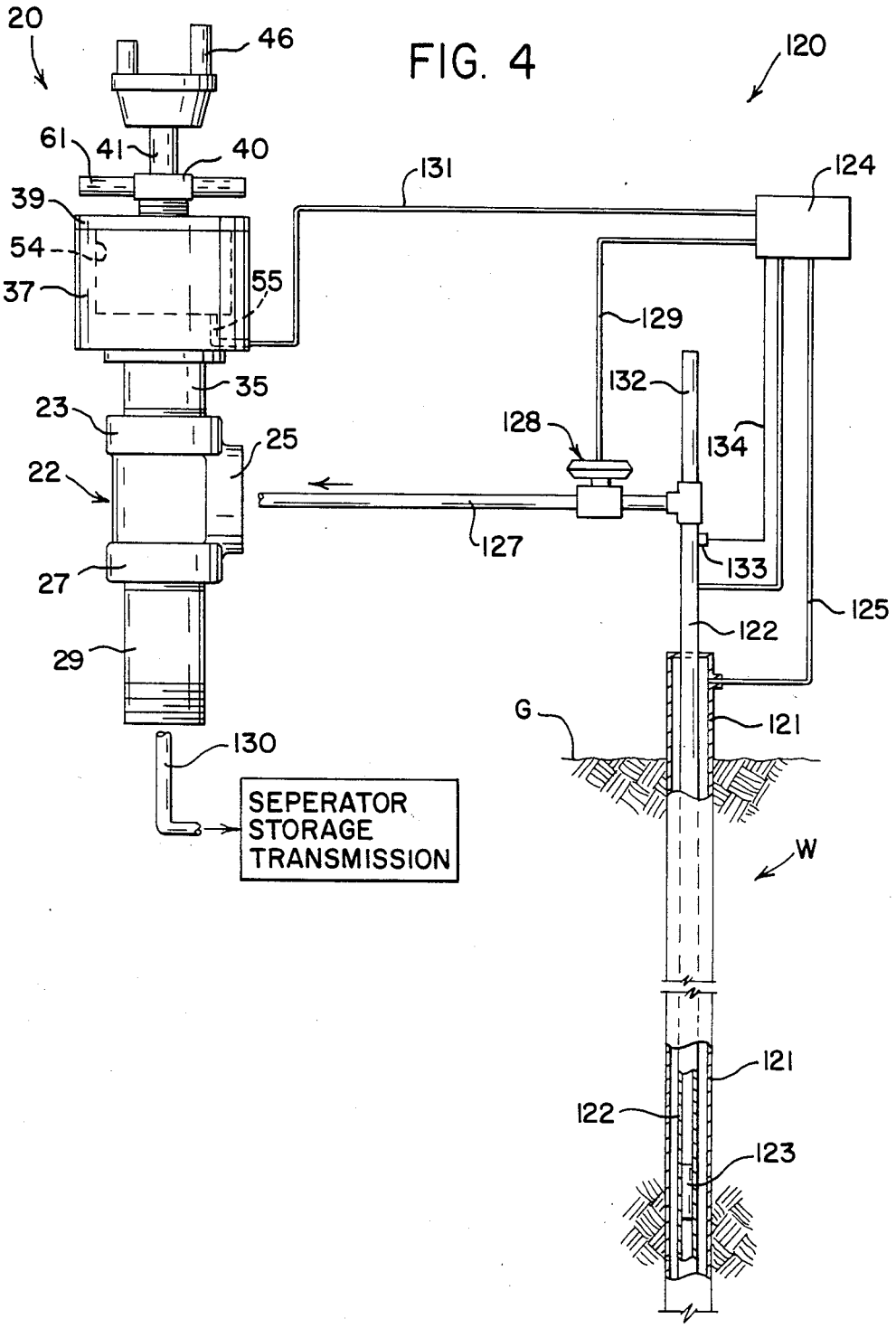
FIG. 4 is a schematic view of the environment of a plunger lift well control system according to the invention using the actuator mechanism, a choke valve element and a piping flow tee according to the invention.

Referring to FIG. 4, the outer casing of a plunger lift well is indicated at 121. The tubing string of the well is indicated at 122. The lift plunger moving up and down the tubing string 122 is indicated at 123. The commands and instructions of the well operator for the functions of the control system 120 may be programmed into a conventional electrically powered well gas actuated control unit 124 having electronic components controlling fluid pressure or pneumatic functions at remote locations.

The control unit 124 is supplied with fluid pressure from the casing 121 by gas transmitted through a conduit 125. The control unit 124 will sense and convert the casing gas pressure to a first analog value used for operation of the system 120. The control unit 124 is also supplied with fluid pressure from the tubing string 122 by gas transmitted through a conduit 126. The control unit 124 will sense and convert the tubing string gas pressure to a second analog value used for operation of the system 120.

The tubing string 122 is connected to the flow tee inlet opening 25 through a transmission pipe 127. Flow of gas and oil through the transmission pipe 127 is controlled by a conventional fluid pressure actuated diaphragm valve 128.

The valve 128 is actuated by fluid pressure transmitted by the control unit 124 through a conduit 129.

Concurrent with programming of the control unit 124, the operator will set and adjust the actuator mechanism 20. When the choke valve element 21 is closed, and is in the "low stage" condition as shown in FIG. 2, gas (low velocity but salable) in the tubing string 122 may flow through pipe 127 into the flow tee 23 and into the transmission pipe 130.

The actuator mechanism 20 will move the choke valve element 21 to the "high stage" condition shown in FIG. 3, in response to fluid pressure transmitted by the control unit 124 through a conduit 131 connected to the control fluid supply conduit 55 in the cylinder member 37. The oil and gas in the tubing string 122 will flow at high velocity through pipe 127 into the flow tee 23 and into the transmission pipe 130.

The choke valve element 21 is moved to the "high stage" condition shown in FIG. 3 when the control unit 124 determines and senses a predetermined difference between the pressure in the casing 121 (high) and the pressure in the tubing string 122 (low). The pressure difference will cause the plunger 123 to move upwardly within the tubing string 122 forcing the oil above the plunger 123 through pipe 127 into the piping flow tee 22 and into the transmission pipe 130.

Movement of the plunger 123 within the tubing string 122 toward an upper pipe extension 132 is determined by a conventional sensor 133. An electrical signal indicating arrival of the plunger 123 within the upper pipe 132 may be transmitted through a line 134 to the control unit 124. The control unit 124 is programmed to respond to the signal from sensor 133 by closing the control valve 128. Upon closing of the valve 128, the plunger 123 will return to the bottom of the tubing string 122. The control unit further responds to the signal from sensor 133 by stopping the transmission of fluid pressure through conduit 131, permitting the control piston coiled spring 63 to return the choke valve element 21 to the "low stage" condition shown in FIG. 2.

What is claimed is:

1. An actuator mechanism for selective positioning of a choke valve element relative to a valve seat within a piping flow tee for regulating the flow of gas and oil from a producing wellhead, said flow tee having an opening to receive and connect said actuator mechanism, an inlet opening for conducting gas and oil toward said choke valve seat and an outlet opening for conducting gas and oil beyond said choke valve seat:

said actuator mechanism comprising a closed body member with a base end adapted for connection with said flow tee opening, a control shaft positioning collar housed within said body member, a cylinder member connected to the upper end of said body member, a control piston housed within said cylinder member, a cap member connected to the upper end of said cylinder member, a control piston stop sleeve carried by said cap member and an elongated control shaft;

said control shaft extending coaxially through said body member, said control shaft positioning collar, said cylinder member, said control piston, said cylinder cap member and said stop sleeve;

said body member, said cylinder member and said stop sleeve each having a small diameter axial bore for rotatable and slidable mounting of said control shaft;

said control shaft having an upper end projecting above said stop sleeve and adapted for carrying a handwheel thereon and a lower end projecting below said body member and into said flow tee and adapted for carrying said choke valve element thereon;

said body member upper end having a larger diameter chamber bore extending radially above said axial bore therein for nonrotatable mounting and seating of said control shaft positioning collar;

said cylinder member having a larger diameter piston bore extending radially above said axial bore therein for movable mounting of said control piston and a control fluid supply conduit extending from the external surface of said cylinder member and into the lower face of said piston bore;

said cylinder cap member having an axial bore therein adapted for rotatable and manually adjustable mounting of said stop sleeve coaxially around the section of said control shaft within said cylinder member;

said control shaft being connected to said control piston within said cylinder piston bore and raisable toward said cylinder cap member in response to the pressure of a control fluid introduced into said piston bore through said cylinder fluid supply conduit, and against a compression means seated around said stop sleeve between said cap member and said control piston;

said control shaft having a section within said body member adapted for rotatable engagement with said control shaft positioning collar.

2. An actuator mechanism according to claim 1 wherein said control shaft positioning collar has an axial portion with internal threads for mating engagment with external threads on a portion of said control shaft, and said positioning collar is nonrotatably secured within said body member chamber bore by a slide pin inserted into and projecting above a shoulder of said chamber bore for seating said positioning collar.

3. An actuator mechanism according to claim 1 wherein said cylinder cap member has an exhaust port therethrough and said axial bore therein has internal threads for mating engagement with external threads on said control piston stop sleeve, and the upper end of said stop sleeve has handle elements for manual rotation thereof.

4. A system to control the flow of gas and oil from the tubing string of a plunger lift well having a casing and using the actuator mechanism, choke valve element and piping flow tee as claimed in claim 1, said system including an electrically powered well gas actuated control unit having electronic components to actuate fluid pressure functions, at remote locations, wherein:

said control unit is supplied with gas from said casing through a conduit and said control unit will convert said casing gas pressure to a first analog value;

said control unit is also supplied with gas from said tubing string through a conduit and said control unit will convert said tubing string gas pressure to a second analog value;

said tubing string communicates with said piping flow tee through a transmission pipe, said transmission pipe having a control valve actuated by said control unit; whereby, the flow of tubing string gas into said piping flow tee is controlled by manual setting of said choke valve element to a "low stage" condition and the opening of said transmission pipe control valve by said control unit; said tubing string thereafter being filled with oil above the plunger until said control unit senses a predetermined difference between said first analog value and said second analog value and said control unit actuates the control piston of said actuator mechanism by the introduction of fluid pressure into the cylinder member piston bore through a control fluid supply conduit and said choke valve element is moved to a "high stage" condition so that oil above said plunger in said tubing string will flow into said piping flow tee.

* * * * *

UNITED STATES PATENT AND TRADEMARK OFFICE

CERTIFICATE OF CORRECTION

PATENT NO. : 4,617,992

DATED : October 21, 1986

INVENTOR(S) : Thomas E. Abel

It is certified that error appears in the above-identified patent and that said Letters Patent are hereby corrected as shown below:

Col. 5, line 62 -- after "element 21 is"

insert -- not

Signed and Sealed this

Fifth Day of April, 1988

*Attest:*

*Attesting Officer*

DONALD J. QUIGG

*Commissioner of Patents and Trademarks*